US006059533A

United States Patent [19]

Stoker et al.

[11] Patent Number: 6,059,533

[45] Date of Patent: May 9, 2000

[54] DAMPED BLADE HAVING A SINGLE COATING OF VIBRATION-DAMPING MATERIAL

[75] Inventors: Eric Stoker, Hawthorne; Stan Pollitt, Rancho Palos Verdes; Terry Morris, Garden Grove; Bob Chen, Torracne; Ramish Doshi, La Palme, all of Calif.

[73] Assignee: AlliedSignal Inc., Morristown, N.J.

[21] Appl. No.: 09/083,822

[22] Filed: May 22, 1998

Related U.S. Application Data

[60] Provisional application No. 60/052,813, Jul. 17, 1997.

[51] Int. Cl.[7] ..... B63H 1/15

[52] U.S. Cl. ..... 416/241 B; 416/241 R; 416/229 A; 416/500; 415/119; 415/200

[58] Field of Search ..... 415/119, 200; 416/229 A, 241 B, 241 R, 500; 427/450, 451, 422

[56] References Cited

U.S. PATENT DOCUMENTS

| | | | |
|---|---|---|---|
| 3,301,530 | 1/1967 | Lull . | |
| 3,758,233 | 9/1973 | Cross et al. . | |
| 3,794,445 | 2/1974 | Watanabe et al. . | |
| 4,023,249 | 5/1977 | Darrow et al. . | |
| 4,233,342 | 11/1980 | Aichert et al. . | |
| 4,241,110 | 12/1980 | Ueda et al. . | |
| 4,257,741 | 3/1981 | Betts et al. . | |
| 4,492,522 | 1/1985 | Rossmann et al. . | |
| 4,826,734 | 5/1989 | Jackson et al. | 428/472 |
| 4,884,820 | 12/1989 | Jackson et al. . | |
| 4,980,241 | 12/1990 | Hoffmueller et al. . | |
| 5,223,332 | 6/1993 | Quests | 428/216 |
| 5,290,507 | 3/1994 | Runkle | 419/14 |
| 5,858,469 | 1/1999 | Sahoo et al. | 427/451 |

*Primary Examiner*—Edward K. Look
*Assistant Examiner*—Ninh Nguyen
*Attorney, Agent, or Firm*—William J. Zak, Jr., Esq.

[57] ABSTRACT

A vibration damped turbo-machine blade includes a shot peened metallic substrate which provides a shape for the blade. Carried on the metallic substrate and bonded to an outer surface of this substrate is a singular ceramic coating of a damping material. The substrate may be made of forged titanium, and the coating may be made of a ceramic material including cobalt at a weight percentage of from about 13% to about 21%, with the balance of the ceramic material being substantially all tungsten carbide.

18 Claims, 2 Drawing Sheets

DAMPED BLADE HAVING A SINGLE COATING OF VIBRATION-DAMPING MATERIAL

This application claims the benefit of Stoker et al. provisional application Ser. No. 60/052,813 filed on Jul. 17, 1997.

BACKGROUND OF THE INVENTION

The present invention relates in general to vibration damped blades for turbo-machinery. More particularly, the present invention relates to vibration damped fan and compressor blades for such turbo machinery, which blades include a metallic substrate and a vibration damping coating bonding with a surface of the metallic substrate and defining an exterior surface for the blades.

Turbo-machinery such as combustion turbine engines and air cycle machines include high-speed turbine wheels, compressor wheels, and fans that expand, compress, and move ambient air or other working fluids. Blades of the wheels and fans frequently encounter vibrations. The vibrations can affect fatigue life of the blades and, consequently, shorten the useful life of the blades.

U.S. Pat. No. 3,301,530 to W. R. Lull and U.S. Pat. No. 3,758,233 to Cross et al. both show vibration damping coatings applied to turbo-machine blades. The blades and coatings shown in the Lull and Cross et. al. patents both carry coatings of more than one layer. The Lull patent shows intermediate and overlying outer sub-layers that are both made of metals having differing coefficients of elasticity. Similarly, the Cross et. al. patent shows coating sub-layers that are selected from a ceramic, and from a mixture of the selected ceramic along with the metal from which the turbo-machine blade itself is formed.

Such damped blades and vibration damping coatings utilizing plural sub-layers can be both expensive and difficult to manufacture. Particularly, the vibration damping coatings can be difficult to apply successfully. Because of the necessity to control such factors as the thicknesses of the sub-layers, the interbonding of the sub-layers with the substrate of the blade and with one another, and other manufacturing parameters, the opportunities for error in the manufacture of such vibration damped blades is increased, and the opportunities for variability in the manufacturing process are multiplied. The differing materials of the sub-layers shown in the Lull and Cross et al. patents are likely to have differing coefficients of thermal expansion that may lead to separation of these layers during manufacturing or during use of the blade. Thus, manufacturing costs for vibration damped blades utilizing the known technology may be high, and scrap and error rates may also be excessive.

SUMMARY OF THE INVENTION

The present invention can be regarded as a vibration damped blade that overcomes one or more of these problems. The vibration damped blade includes a metallic substrate, and a singular ceramic vibration damping coating carried on an outer surface of the metallic substrate; with the singular coating forming both an interface with the outer surface of the metallic substrate and extending outwardly to define a respective outer surface of the ceramic coating, with intermediate material of the coating between the two interfaces of the coating being substantially homogeneous.

BRIEF DESCRIPTION OF THE DRAWING FIGURES

DETAILED DESCRIPTION OF THE INVENTION

Figure 1:
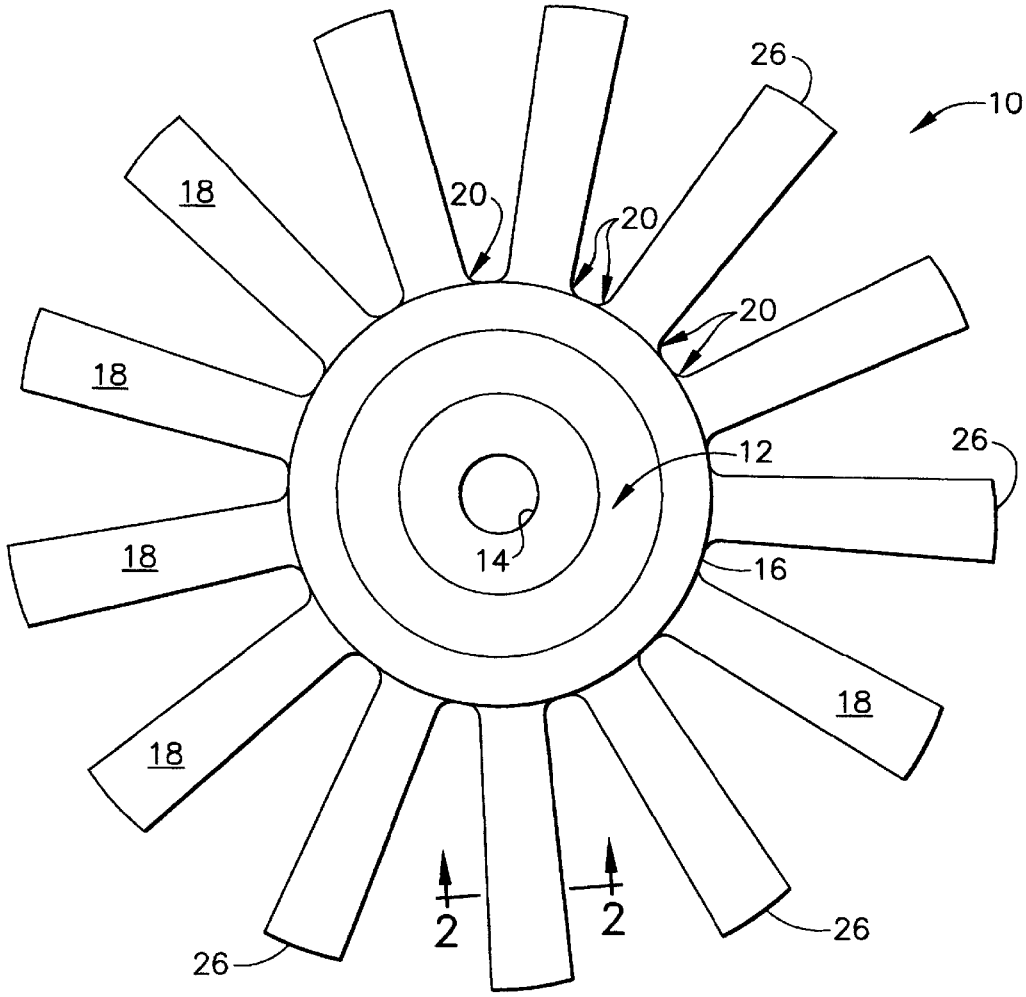
FIG. 1 is an axial view of a turbo-machine fan having plural blades, each of which is damped in accord with the present invention.

FIG. 1 shows an exemplary turbo-machine fan 10. It is understood that the present invention is not limited to embodiment in such a fan 10, but may also be applied to and embodied in, for example, compressor blades and turbine blades of turbo-machinery. The fan 10 includes a hub portion 12 defining a central bore 14, through which a tie bolt (not shown) may pass in order to secure the fan to other components (also not shown) of a turbo-machine. The hub portion 12 defines an outer circumferentially extending surface 16 from which plural fan blades 18 extend radially. The blades 18 are in this case integral with the hub portion 12, although such need not be the case. Each blade 18 includes a substrate having a root radius portion 20 which the blade blends into the hub portion 12, a leading edge 22, a trailing edge 24, and a radially outer tip surface 26. Generally the hub 12 and blades 18 are formed of metal. Particularly, the hub 12 and blades 18 may be formed of titanium metal. Additionally, the surfaces of the blade substrates are shot peened. The shot peening creates residual compressive strength in the substrates. A forged and shot peened form of titanium metal known as Ti 6Al-4V may be used for the fan 10 of an air cycle machine.

Figure 2:
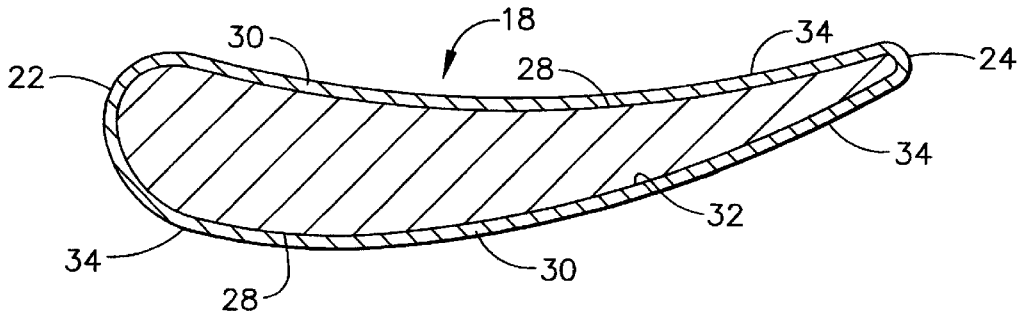
FIG. 2 is a cross sectional view taken at line 2—2 of FIG. 1.

As is seen in FIG. 2, the metal blades 18 define an outer surface 28 (i.e., a metal surface) to which is bonded a singular homogeneous coating 30 of vibration damping material. The vibration damping coating 30 defines an interface at 32 with the metal surface 28, and extends outwardly to define an outer surface 34. It is the outer surface 34 of the coating on blades 18 which is shown in FIG. 1. In between the interface 32 and the outer surface 34, the material of coating 30 is substantially homogeneous, and has no internal interfaces or sub-layers. The material most favored for the coating 30 is tungsten carbide cobalt. This tungsten carbide cobalt material may be applied using a variety of available processes, but a process known as HVOF (high velocity oxygen-fuel) has been used successfully to practice the invention. Other available application processes such as CVD, PVD, thermal spray, detonation gun, and plasma spray application may be used to apply the coating 30.

Surprisingly, the tungsten carbide cobalt material actually has a coefficient of elasticity which is higher than that of the metal from which the fan 10 is formed, so that one might believe that any cracks which formed in the coating 30 would propagate into the underlying metal and result in a shortened service life for the fan 10. However, the improvement in fatigue life of the combined metal substrate forming the blades 18 along with the coating 30 and the residual compressive strength from the shot peening results in a longer life for the blades 18 (in contrast to a blade having only a titanium metal substrate).

Most preferably, the coating 30 is applied to the surface 28 of the metal blades in a thickness of from about 0.003 inch to about 0.008 inch everywhere except at the blade root radius area 20 and at the blade tip surface 26. At the blade root radius 20, the coating 30 is about 0.001 inch thick. No coating is required at the tip surface 26. The constituents of coating 30, by weight, are most preferably:

| | |
|---|---|
| Cobalt | 13% to 21% |
| Tungsten carbide | balance |
| Other | max of 1% |

Microhardness of the applied coating 30 is preferably 900 HV300 minimum when tested according to the ASTM E 384 standard. A bond strength of the coating 30 to the surface 28 of the titanium metal of 10,000 psi minimum is preferred, when tested in accord with ASTM standard C 633. Testing of a fan embodying the present invention as described herein has shown an improvement in fatigue life of about two and half to one over the life of a fan made only from the forged titanium metal alone with no vibration damping coating on it.

Figure 3:
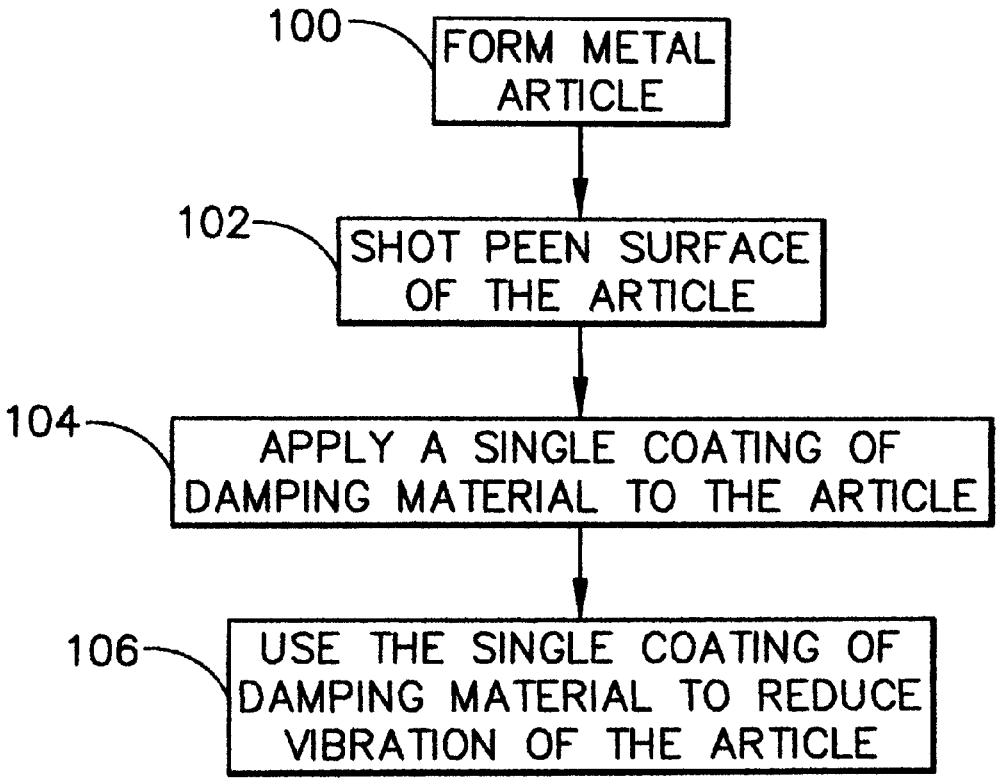
FIG. 3 is a flow chart of a method of making a vibration damped blade according to the present invention.

A method of making the present vibration damped blade, as illustrated in FIG. 3, includes steps of forming a blade substrate of a metallic material having a metallic surface (block 100); shot peening the metallic surface of the substrate (block 102), applying and bonding to this metallic surface a singular layer of damping material (block 104); and using the single layer of damping material to reduce vibrations of the substrate of metallic material (block 106). Additionally, it is seen that the single layer of vibration damping material is utilized to define an interface with the metallic substrate, and that the layer of damping material extends homogeneously outwardly of the metallic surface of the substrate to define an outer surface for the blade.

The metallic substrate for the blade may be formed of forged titanium selected as Ti 6Al-4V alloy. This forged titanium form for the blade is shot peened all over (including the root portion) before the single layer of vibration damping material is applied. A single layer of vibration damping material having a thickness between about 0.001 inch and about 0.008 inch is then applied and bonded to the metallic surface of the substrate by using a process such as thermal spraying.

A specific embodiment of the invention has been described and illustrated above. However, the invention is not limited to the specific forms or arrangements of parts so described and illustrated. For example, the substrate could be made of aluminum or steel bar stock or casting instead of forged titanium. Residual compressive strength can be created in a substrate by ways other than shot peening. Accordingly, the invention is construed according to the claims that follow.

We claim:

1. A turbo-machine blade comprising:

a metallic substrate defining a metallic surface; and a singular layer of damping material bonding to said metallic surface and defining an interface therewith, said single layer of damping material extending outwardly of said metallic surface to define an outer surface for said blade, said single layer of damping material extending from said interface to said outer surface substantially homogeneously, said layer being thinnest at a root radius area of the blade.

2. The blade as claimed in claim 1 in which said metallic substrate is formed of forged titanium.

3. The blade as claimed in claim 1 in which said forged titanium is Ti 6Al-4V alloy.

4. The blade as claimed in claim 1 wherein said substrate has residual compressive strength.

5. The blade as claimed in claim 1 in which said layer of damping material has a thickness between said metallic surface and said outer surface in the range from about 0.001 inch to about 0.008 inch.

6. The blade as claimed in claim 1 in which said layer of damping material is formed from a material comprising tungsten carbide.

7. The blade as claimed in claim 1 in which said layer of damping material is formed from a material including cobalt at a weight percentage of from about 13% to about 21%, with the balance being substantially all tungsten carbide.

8. The blade as claimed in claim 1, wherein the layer does not cover a tip surface of the blade.

9. A method of providing a damped blade, said method comprising steps of:

providing a blade substrate of a metallic material, said blade substrate defining a metallic surface;

creating a residual compressive strength in the substrate; and applying and bonding to said metallic surface a singular layer of damping material while using said damping material to define an interface with said metallic material, and extending said single layer of damping material homogeneously outwardly of said metallic surface to define an outer surface for said blade, said layer being thinnest at a root radius area of the blade.

10. The method of claim 9, wherein the residual compressive strength is created by shot peening said outer surface of said blade metallic substrate.

11. The method of claim 9, further including the step of applying said damping material layer over said metallic surface to a thickness in the range of from about 0.001 inch to about 0.008 inch.

12. The method of claim 9, further including the step of forming said layer of damping material from a material consisting essentially of cobalt at a weight percentage of from about 13% to about 21%, with the balance being substantially all tungsten carbide.

13. The method of claim 9 wherein said layer of damping material is applied to said metallic surface using a thermal spray process.

14. A rotating component of a turbo-machine, the component comprising a central hub; and a plurality of blades extending outward from the hub, at least one of the blades including:

a shot peened metallic substrate providing a shape for said blade; said metallic substrate carrying a singular ceramic vibration damping coating;

said singular ceramic vibration damping coating defining two interfaces, one of said two interfaces being defined with said metallic substrate, and the other of said two interfaces being defined by said singular ceramic layer of damping material as an outer surface of said vibration damped blade, said singular ceramic vibration damping coating being substantially homogeneous between said two interfaces and being free of interior sub-layer interfaces, said coating being thinnest at a root radius area of the blades.

15. The component as claimed in claim 14 in which said singular ceramic damping coating has a thickness between said metallic substrate and said outer surface in the range from about 0.001 inch to about 0.008 inch.

16. The component as claimed in claim 14 in which said singular ceramic damping coating is formed from a ceramic material including cobalt at a weight percentage of from about 13% to about 21%, with the balance being substantially all tungsten carbide.

17. The component as claimed in claim 16, wherein said singular ceramic damping coating has an ASTM E-384 microhardness of at least 900 HV 300.

18. The component as claimed in claim 14, wherein the coating does not cover a tip surface of the blade.

* * * * *